US009527711B2

(12) United States Patent
Recchia et al.

(10) Patent No.: US 9,527,711 B2
(45) Date of Patent: Dec. 27, 2016

(54) LIFT FRAME FOR AN INDUSTRIAL TRUCK

(71) Applicant: Jungheinrich Aktiengesellschaft, Hamburg (DE)

(72) Inventors: John Recchia, Detroit, MI (US); Kelvin Chan, Jersey Village, TX (US)

(73) Assignee: Jungheinrich Aktiengesellschaft, Hamburg (DE)

( * ) Notice: Subject to any disclaimer, the term of this patent is extended or adjusted under 35 U.S.C. 154(b) by 317 days.

(21) Appl. No.: 14/296,038

(22) Filed: Jun. 4, 2014

(65) Prior Publication Data

US 2015/0353332 A1 Dec. 10, 2015

(51) Int. Cl.
*B66F 9/20* (2006.01)
*B66F 9/08* (2006.01)

(52) U.S. Cl.
CPC *B66F 9/205* (2013.01); *B66F 9/08* (2013.01)

(58) Field of Classification Search
CPC ..... B66F 9/205; B66F 9/08
USPC ..... 187/228
See application file for complete search history.

(56) References Cited

U.S. PATENT DOCUMENTS 2,736,445 A * 2/1956 Hoban ..... B66F 9/205 414/640
2,932,419 A * 4/1960 Harris ..... B66F 9/205 174/47
3,080,943 A * 3/1963 Goodall ..... B66F 9/08 187/228
3,612,318 A * 10/1971 Ramsey ..... B66F 9/205 137/355.25
3,894,616 A * 7/1975 Kawanishi ..... B66F 9/08 187/228
4,092,997 A * 6/1978 Hansen ..... F16L 3/01 137/351
4,244,449 A * 1/1981 Renk ..... B66F 9/205 187/228
4,266,744 A * 5/1981 Bergman ..... H02G 11/00 187/228
4,374,550 A * 2/1983 Bartow ..... B66F 9/205 187/227
4,493,397 A * 1/1985 Maes ..... B66F 9/08 187/228
4,503,936 A * 3/1985 Rice ..... B66F 9/205 187/228
4,683,987 A * 8/1987 Sakata ..... B66F 9/205 187/228
4,691,806 A * 9/1987 Jansen ..... B66F 9/205 137/355.17
4,725,186 A * 2/1988 Jerue ..... B66F 9/181 414/620
5,992,571 A * 11/1999 Lee ..... B66F 9/205 187/228

(Continued)

*Primary Examiner* — William A Rivera
*Assistant Examiner* — Michael Riegelman
(74) *Attorney, Agent, or Firm* — Walter Ottesen, P.A.

(57) ABSTRACT

A lift frame has a lift mast along which a lift carriage is arranged so as to be movable in elevation. At least one hydraulic line progresses along the lift mast and a tensioning device is provided for the hydraulic line. The tensioning device has a bracket mounted permanently on the lift frame and a deflection section for the hydraulic line. The deflection section can be selectively mounted at different elevations on the bracket to adjust the tension in the hydraulic line. An industrial truck incorporating the lift mast is also disclosed.

6 Claims, 5 Drawing Sheets

(56) References Cited

U.S. PATENT DOCUMENTS

| | | | | |
|---|---|---|---|---|
| 7,255,201 | B2 | 8/2007 | Rieder et al. | |
| 2006/0104780 | A1* | 5/2006 | Schottke | B66F 9/08 414/592 |
| 2007/0012520 | A1* | 1/2007 | Hayashi | B66F 9/08 187/228 |

* cited by examiner

LIFT FRAME FOR AN INDUSTRIAL TRUCK

FIELD OF THE INVENTION

The present invention relates to a lift frame for an industrial truck, along which a lift carriage is arranged in a height-displaceable manner.

BACKGROUND OF THE INVENTION

For a hydraulic supply within a lift frame, it is required to arrange one or more hydraulic lines within the lift frame and to position them advantageously for operation of the lift frame.

A lift frame for an industrial truck, in which hydraulic hoses are arranged for auxiliary hydraulics, is known from U.S. Pat. No. 7,255,201 B2. The known lift frame includes a stationary mast and at least one lift mast displaceable relative thereto. The lift mast has a lift carriage that can be moved up and down, in which auxiliary hydraulics are provided. A hydraulic hose, which is displaced along the lift frame, ends at the lift carriage, wherein a loop open toward the top is formed in a lower end of the lift frame. The hydraulic hose is guided with its loop around a tensioning pulley which is fastened on a pulley carrier. The pulley carrier is arranged in a height-adjustable manner on the lift frame in order to build up pretension for the hydraulic hose during lifting of the lift carriage together with the upper end of the hydraulic hose. For this, the pulley carrier, which maintains the pretension due to its tare weight or additional weights, is mounted in a height-adjustable manner on the lift frame.

Besides the known solution of holding a hydraulic hose, the one end of which moves in height, under pretension also during the height adjustment, the problem also exists of holding a hydraulic hose, which is arranged tightly against the lift frame along the lift frame, under constant pretension. As is known, hydraulic hoses are preferably made of plastic or rubber and plastic composites so that an elongation of the hose, so-called creeping, can occur because of material fatigue in the case of a hydraulic hose under constant pretension. The hydraulic hose hereby loses some pretension and its exact position within the lift frame can be lost. In the case of the known solutions for an arrangement of the hydraulic hose under pretension, an imprecise positioning and play occurs in the hose guide through the elongation of the hose.

SUMMARY OF THE INVENTION

It is an object of the invention to hold hydraulic hoses arranged in a lift frame under pretension permanently under a desired pretension with simple means.

The lift frame of the invention includes: a lift mast; at least one hydraulic line running along the lift mast; a tensioning device configured to tension the at least one hydraulic line; the tensioning device having a bracket mounted permanently on the lift frame and a deflection section for the at least one hydraulic line; and, the deflection section being configured to be mounted at different elevations on the bracket so as to adjust the tension in the hydraulic line.

The lift frame according to the invention has a lift mast, along which a load bearer is arranged in a height-displaceable manner. At least one hydraulic line, for which at least one tensioning device is provided, is arranged along the lift mast. The tensioning device according to the invention includes a bracket mounted permanently on the lift frame and a deflection section for the at least one hydraulic line. According to the invention, the deflection section can be mounted selectively at different heights on the bracket. The deflection section guides the hydraulic line in a loop that is open in the upward direction. A pretension for the hydraulic line can thus be created through a height adjustment of the deflection section. The use of a bracket mounted permanently on the lift frame and a deflection section mounted selectively at different elevations on the bracket permits the re-establishment of a pretension lost through the elongation of the hydraulic line by shifting of the height of the deflection section relative to the bracket.

In a preferred embodiment, the deflection section has a U-shaped contact surface for the at least one hydraulic line, in order to deflect the line by an angle of approximately 180°. A mainly U-shaped contact surface permits the deflection of the hydraulic line without bending or otherwise stressing it too greatly.

In a preferred embodiment, the bracket has an elongated hole or through slot, on which the deflection section is guided in a height-adjustable manner. The elongated hole in the bracket thereby has an orientation parallel to the longitudinal direction of the lift frame so that the deflection section can be adjusted so as to set the pretension for the at least one hydraulic line along the elongated hole.

Fasteners are also preferably provided in order to interconnect the bracket and deflection section in a desired position relative to each other. Fastening bore holes corresponding to each other are preferably provided for this in the bracket and in the deflection section. Elongated fastening bodies are guided through the fastening bore holes. While the height adjustment via an elongated hole permits the re-establishment of the pretension for the hydraulic line when the fasteners are released, the fasteners permanently fasten the deflection section on the bracket. Thus, if elongation has occurred on the hydraulic line for example because of a long-lasting pretension, the hydraulic line can be correspondingly retensioned when the fasteners are released by shifting of the deflection section in the elongated hole and subsequently refastening the deflection section on the bracket.

In a preferred embodiment, the position of the tensioning device and the length of the at least one hydraulic line are adjusted with respect to each other such that a pretension can be applied to the at least one hydraulic line by the height adjustment of the deflection section relative to the bracket. The application of the pretension through a simple shifting of the deflection section relative to the bracket permits the quick re-establishment of the desired pretension in case of an elongation of the hydraulic line.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
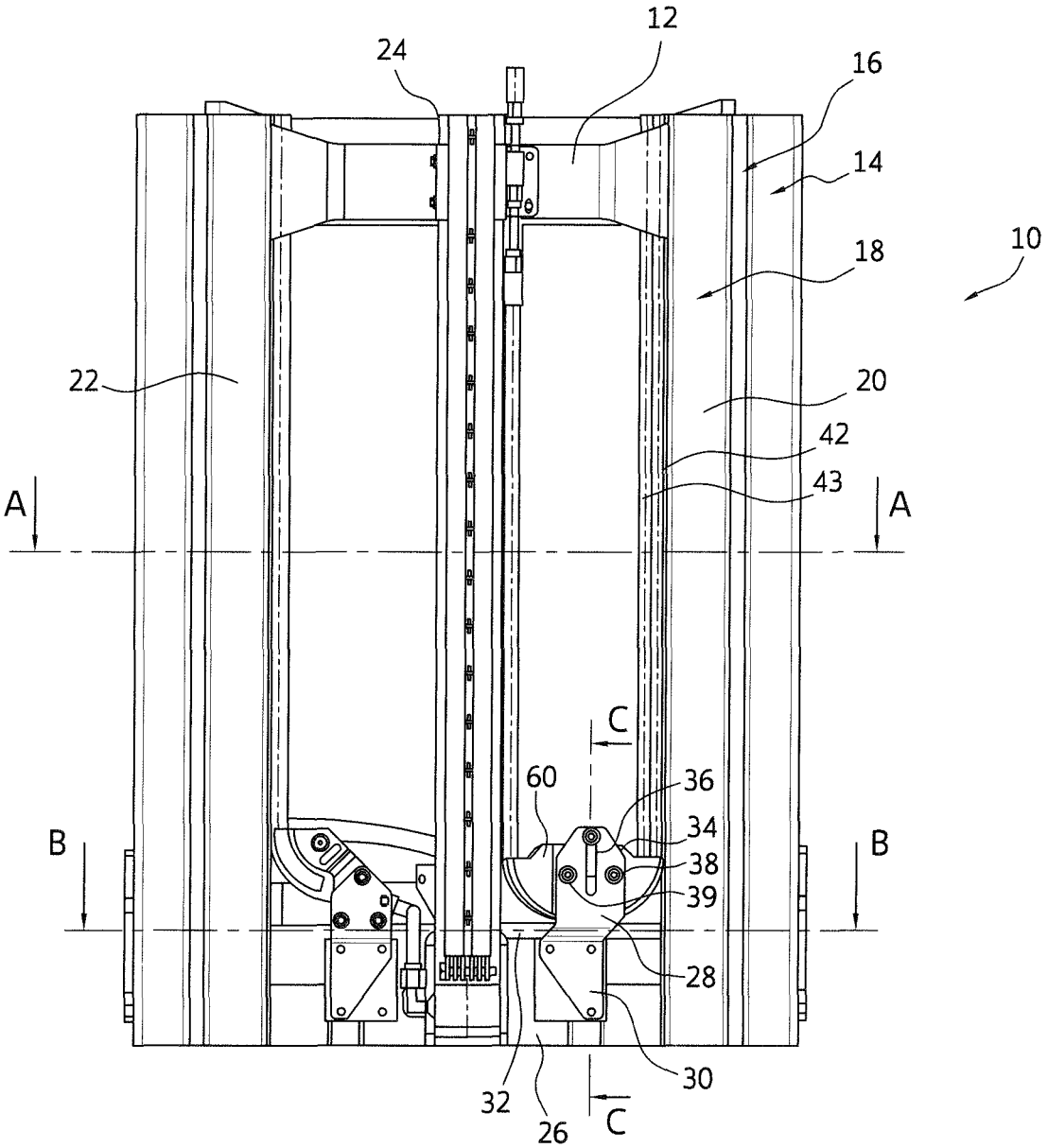
FIG. 1 is a front elevation view of a lower section of the lift frame according to the invention.

FIG. 1 shows a lower section of a lift frame 10 which is cut to the height of the crossmember 12. The lift frame 10 has three frame-shaped lift masts arranged inside each other of which an outer mast 14 is permanently attached to the vehicle and two inner masts 16, 18 are telescopably arranged with respect to the outer mast 14. The masts each have two rails, for example the rails 20, 22 of the inner mast 18. The rails 20, 22 are interconnected via a plurality of cross-beams. Of these cross-beams of inner mast 18, the crossmember 12 is shown below where the lift frame 10 is cut through transversely to the longitudinal direction.

It can also be seen in FIG. 1 that a hydraulic cylinder 24 is arranged centrally in the lift frame. The hydraulic cylinder 24 is also shown cut through in FIG. 1. The inner lift masts 16 and 18 can be lifted relative to the outer mast 14 via the hydraulic cylinder 24.

Figure 2:
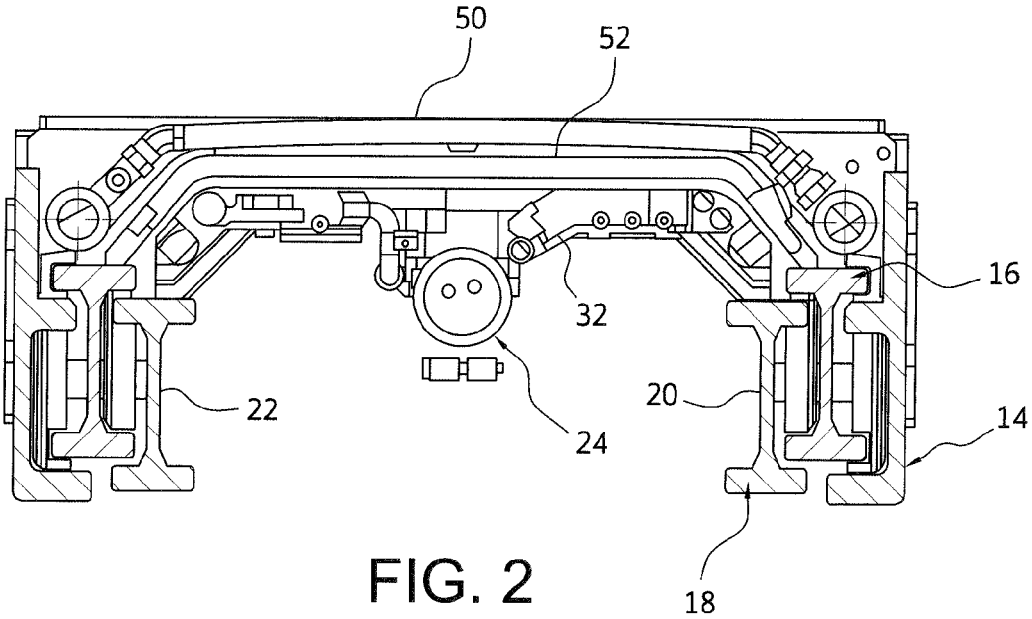
FIG. 2 is a section view taken along line A-A of the lift frame of FIG. 1.
Figure 3:
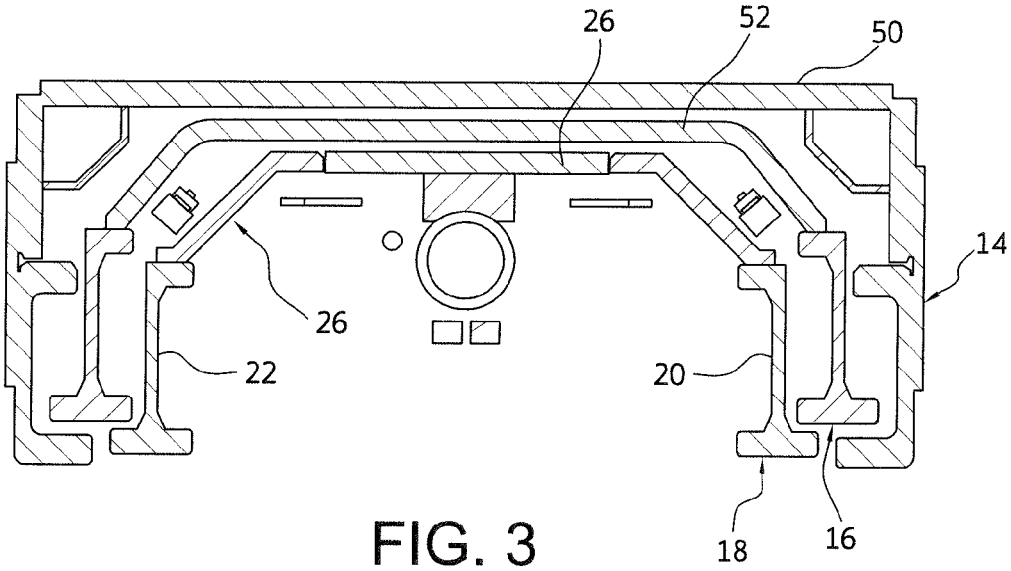
FIG. 3 is a section view taken along line B-B of the lift frame of FIG. 1.

A lower crossmember 26 is arranged between the rails 20, 22 of the lift mast 18. The hydraulic cylinder 24 is applied, for example, both to the lower crossmember 26 as well as to the crossmember 12 of the inner mast 18. The lower crossmembers of lift masts 14 and 16 are identified by reference numerals 50 and 52, respectively, in FIGS. 2 and 3.

A bracket 28 is fastened on the lower crossmember 26. The bracket 28 has a flange 30 which transitions over a ledge 32 into a holding section 34. The holding section 34 has centrally an elongated through opening 36 which extends in the longitudinal direction of the lift frame. Two fastening bore holes 38, 39 are provided in holding section 34 laterally of the elongated through opening 36. The bracket 28 is part of the tensioning device according to a feature of the invention.

Figure 4:
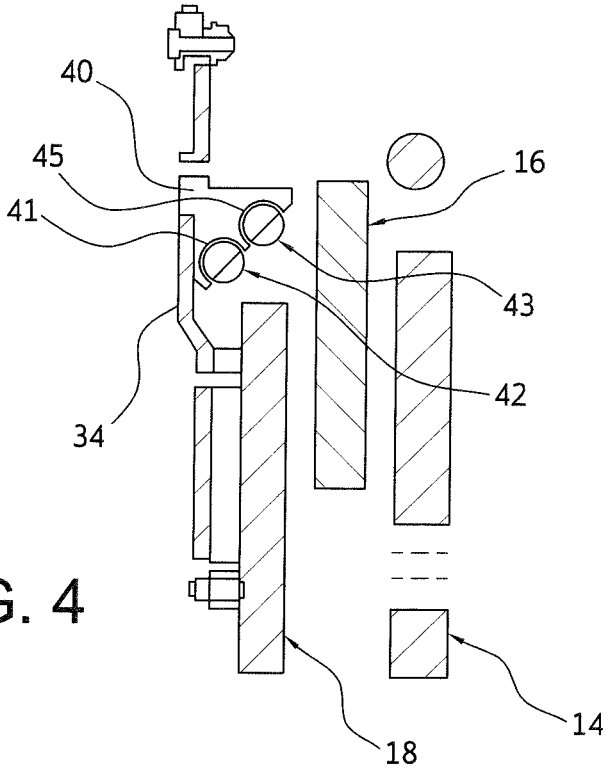
FIG. 4 is a section view taken along line C-C of FIG. 1 and shows details of the tensioning device according to a feature of the invention.

FIG. 4 shows a detailed section view of the tensioning device. The U-shaped deflection section 40 is a router which here deflects two hydraulic lines 42, 43 coming from above by 180°. The hydraulic lines 42, 43 are guided in respective channels 41, 45 formed in the U-shaped deflection section 40 attached to holding section 34.

Figure 5:
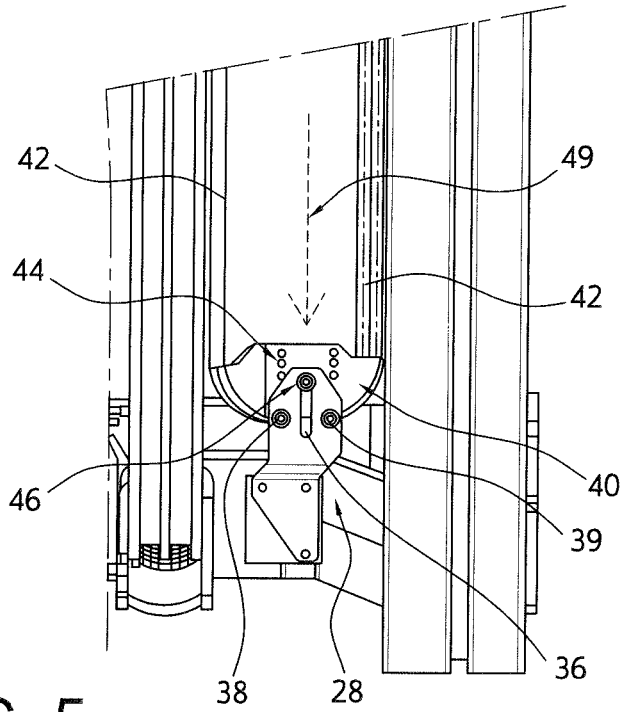
FIG. 5 is a detail view of the deflection section of the tensioning device according to a feature of the invention.

As shown in FIG. 5, the hydraulic line deflection section 40 has, on its back side, a series of fastening bore holes 44 which are arranged laterally of the elongated through opening 36. The lateral distance between the fastening bore holes 44 is equal to the distance between the fastening bore holes 38 on the holding section 34 of the bracket 28.

As indicated by the arrow 49, the deflection section 40 can be displaced within the elongated through opening 36. A pretension is hereby established for the hydraulic lines 42, 43 guided in the router 40. FIG. 4 shows how the hose lines 42, 43 are accommodated in the router 40.

During operation, the deflection section or router 40 can be pressed downwards in the direction of arrow 54 by loosening fastening bolts guided through fastening bore holes 38, 39 in order to retension the hydraulic line 42. The deflection section 40 is then refastened on the bracket 28 via the fastening bolts guided through the fastening bore holes 38, 39, wherein the hydraulic lines 42, 43 are then pretensioned. The deflection section 40 is connected in a loss-proof manner with the bracket 28 via a guide pin 46 arranged in the elongated hole 36 and held thereon.

Figure 6:
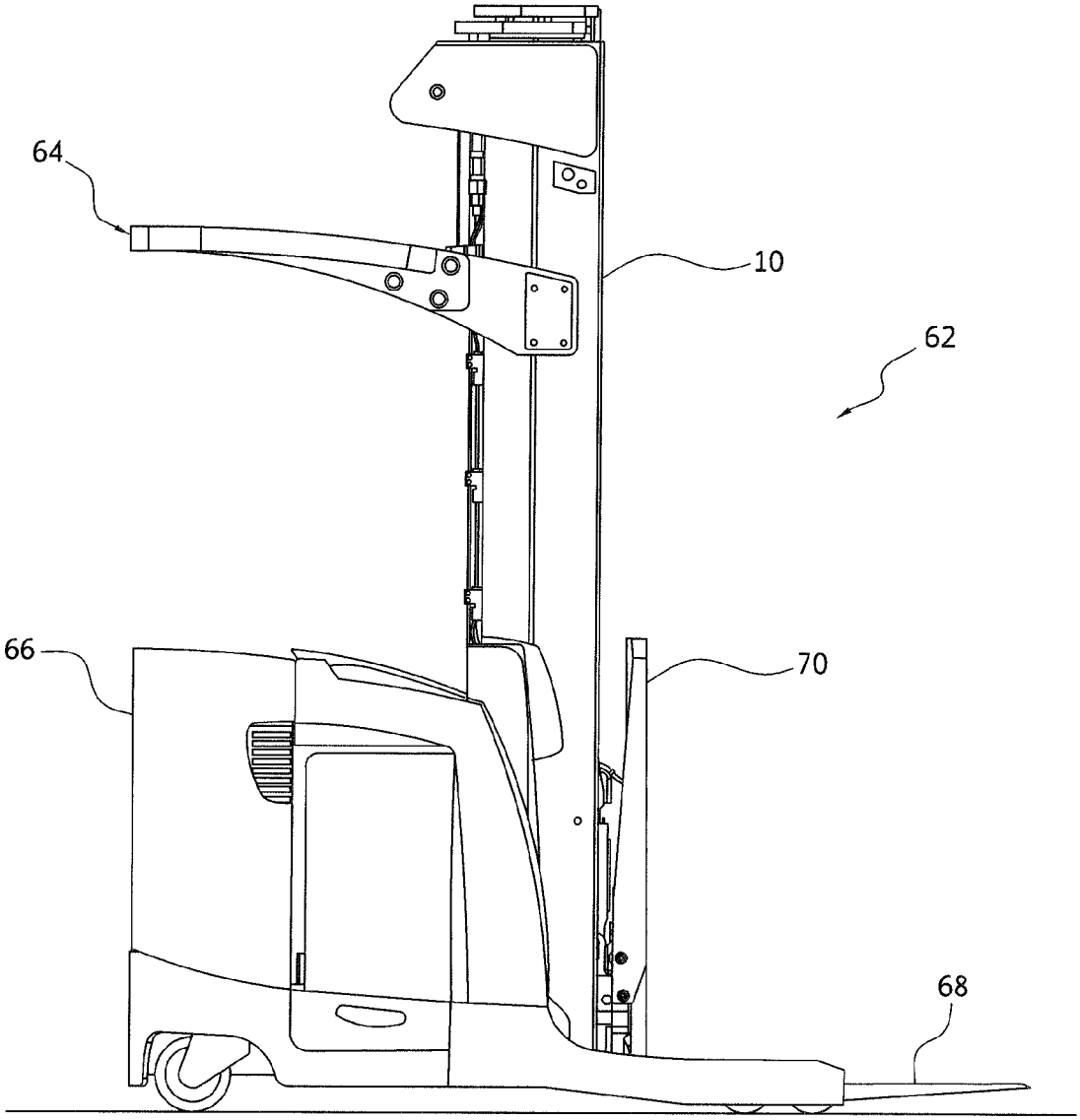
FIG. 6 is a side elevation view of an industrial truck incorporating the lift frame of the invention.

FIG. 6 is a side elevation view of an industrial truck equipped with the lift mast according to the invention. In FIG. 6, the industrial truck 62 is shown as including an overhead guard 64, a chassis 66 and forks 68. The lift mast 10 corresponds to that shown in FIGS. 1 to 5.

Figure 7:
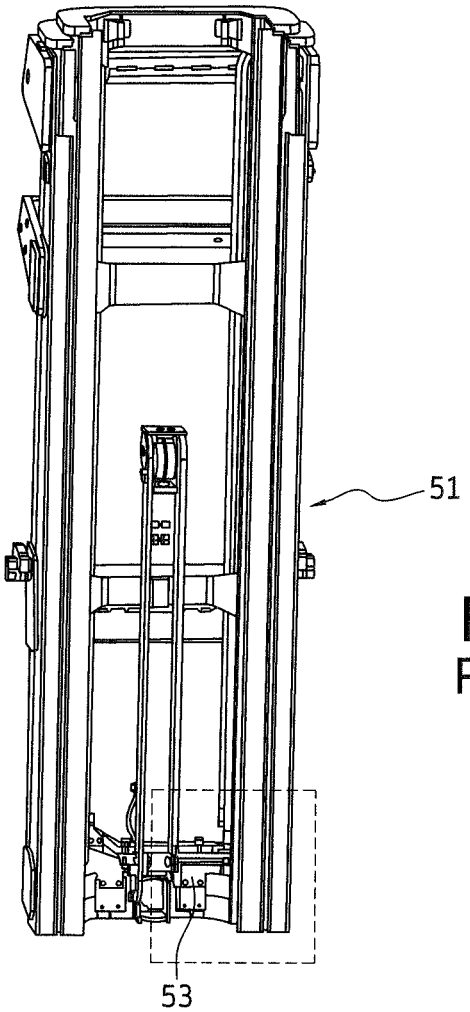
FIG. 7 Prior Art
FIG. 7 is a front end view of a conventional lift frame.
Figure 8:
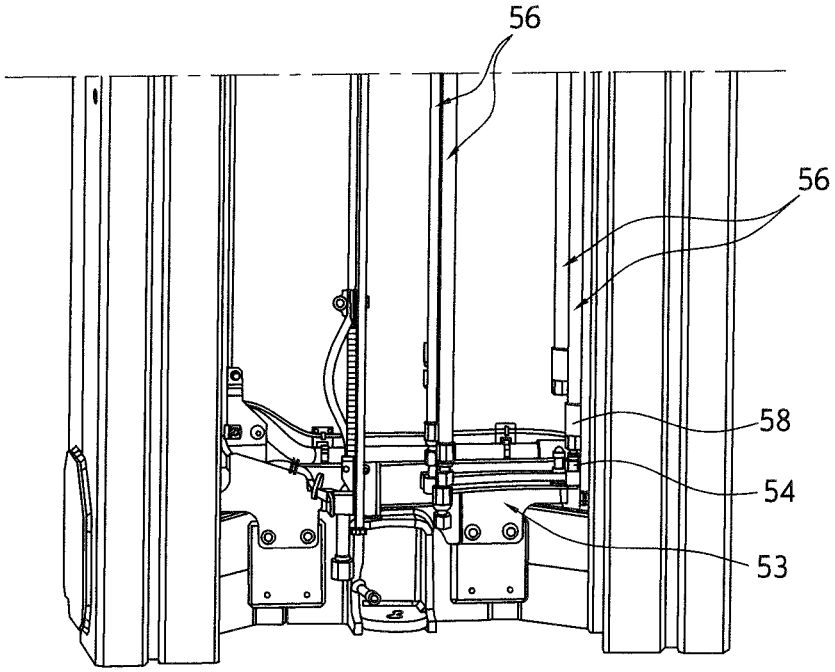
FIG. 8 Prior Art
FIG. 8 a detailed view of the lift frame of FIG. 7.

FIGS. 7 and 8 show a conventional lift mast 51, on the lower end of which a stationary tube section 53 is provided. The tube section 53 has connections 54 for hydraulic lines 56, each of which, with their connections 58, is connected to one of the connections 54 of the tube section 53. In the case of signs of fatigue in the hydraulic line 56, it is not possible to retension the hydraulic lines 56.

It is understood that the foregoing description is that of the preferred embodiments of the invention and that various changes and modifications may be made thereto without departing from the spirit and scope of the invention as defined in the appended claims.

What is claimed is:

1. A lift frame comprising:

a lift mast;

at least one hydraulic line having a length and running along said lift mast;

a tensioning device having a position and being configured to tension said at least one hydraulic line;

said tensioning device having a bracket mounted permanently on the lift frame and a deflection section for said at least one hydraulic line;

said deflection section being configured to be selectively mounted at different discrete elevations on said bracket so as to adjust the tension in said at least one hydraulic line;

a fastener configured to interconnect said bracket and said deflection section;

said bracket having first fastening bore holes;

said deflection section having a first series of second fastening bore holes and a second series of said second fastening bore holes, respective ones of the first series of said second fastening bore holes corresponding to a respective first one of said first fastening bore holes and respective ones of the second series of said second fastening bore holes corresponding to a respective second one of said first fastening bore holes;

said lift frame having a plurality of elongated fasteners each of which is configured to be guided through both corresponding ones of said first and second fastening bore holes; and, said position of said tensioning device and said length of said at least one hydraulic line being configured to be adjustable with respect to each other such that a pretension can be applied to said at least one hydraulic line as a result of a height adjustment of said deflection section relative to said bracket.

2. The lift frame of claim 1, wherein said deflection section has a U-shaped contact surface configured for accommodating said at least one hydraulic line thereon and to deflect said at least one hydraulic line by approximately 180°.

3. The lift frame of claim 1, wherein said bracket defines an elongated through slot; and, said deflection section is held in said elongated through slot in a height-adjustable manner.

4. An industrial truck comprising:

a chassis;

a lift mast mounted on said chassis;

at least one hydraulic line having a length and running along said lift mast;

a tensioning device having a position and being configured to tension said at least one hydraulic line;

said tensioning device having a bracket mounted permanently on the lift frame and a deflection section for said at least one hydraulic line;

said deflection section being configured to be selectively mounted at different discrete elevations on said bracket so as to adjust the tension in said at least one hydraulic line;

a fastener configured to interconnect said bracket and said deflection section;

said bracket having first fastening bore holes;

said deflection section having a first series of second fastening bore holes and a second series of said second fastening bore holes, one of the first series of said second fastening bore holes corresponding to a respective first one of said first fastening bore holes and one of the second series of said second fastening bore holes corresponding to a respective second one of said first fastening bore holes;

said lift frame having a plurality of elongated fasteners each of which is configured to be guided through both corresponding ones of said first and second fastening bore holes; and, said position of said tensioning device and said length of said at least one hydraulic line being configured to be adjustable with respect to each other such that a pretension can be applied to said at least one hydraulic line as a result of a height adjustment of said deflection section relative to said bracket.

5. The industrial truck of claim 4, wherein said deflection section has a U-shaped contact surface configured for accommodating said at least one hydraulic line thereon and to deflect said at least one hydraulic line by approximately 180°.

6. The industrial truck of claim 4, wherein said bracket defines an elongated through slot; and, said deflection section is held in said elongated through slot in a height-adjustable manner.

* * * * *